US006174148B1

(12) United States Patent
Suzuki

(10) Patent No.: US 6,174,148 B1
(45) Date of Patent: Jan. 16, 2001

(54) WATER JET TYPE AIR COMPRESSOR SYSTEM, ITS STARTING METHOD, AND WATER QUALITY CONTROL METHOD THEREOF

(75) Inventor: Nozomu Suzuki, Kawaguchi (JP)

(73) Assignee: Ishikawajima-Harima Heavy Industries Co., Ltd., Tokyo (JP)

( * ) Notice: Under 35 U.S.C. 154(b), the term of this patent shall be extended for 0 days.

(21) Appl. No.: 09/299,741

(22) Filed: Apr. 27, 1999

(30) Foreign Application Priority Data

Jul. 23, 1998 (JP) ..... 10-208162
Jul. 23, 1998 (JP) ..... 10-208166

(51) Int. Cl.[7] ..... F04C 29/02

(52) U.S. Cl. ..... 418/1; 418/87; 418/97; 418/100; 418/DIG. 1; 184/6.16

(58) Field of Search ..... 418/1, 87, 97, 418/100, DIG. 1; 184/6.16

(56) References Cited

U.S. PATENT DOCUMENTS 3,850,554 * 11/1974 Zimmern ..... 418/87
5,033,944 * 7/1991 Lassota ..... 418/100
5,087,178 * 2/1992 Wells ..... 418/DIG. 1

FOREIGN PATENT DOCUMENTS 57-8392 * 1/1982 (JP) ..... 418/DIG. 1
58-148287 9/1983 (JP) .
2-286896 * 11/1990 (JP) ..... 418/100
10054384A 2/1998 (JP) .
10141262A 5/1998 (JP) .

* cited by examiner

*Primary Examiner*—John J. Vrablik
(74) *Attorney, Agent, or Firm*—Griffin & Szipl, P.C.

(57) ABSTRACT

Upon starting instruction of a compressor before the compressor is started, a pressurized water jet line 20 is opened and pressurized water is jetted to the inside of the compressor. By this manner, a dry operation with rotors and a mechanical seal kept in a dry state is definitely prevented and the compressor can be started even after it is stopped for a long hour. Further, the compressed air is supplied to the inside of the water tank, and the water from the water tank is jetted to the inside of the compressor by its pressure. The compressed air ejected from the water tank is cooled below a saturation temperature of water content and the water content thereof is condensed and separated. The separated water content is supplied to the inside of the compressor, and an excess circulating water is discharged from the water tank. Thus, a long hour continuous operation can be performed without replenishing water.

5 Claims, 6 Drawing Sheets

WATER JET TYPE AIR COMPRESSOR SYSTEM, ITS STARTING METHOD, AND WATER QUALITY CONTROL METHOD THEREOF

BACKGROUND OF THE INVENTION

(1) FIELD OF THE INVENTION

The present invention relates to a water jet type air compressor system into which water is jetted in order to perform lubrication or the like, a starting method for the system, and a water quality control method for the system.

(2) DESCRIPTION OF THE RELATED ART

FIG. 1 is a schematic view of a screw compressor. In this drawing, a screw compressor 10 is a biaxial screw compressor, which is constituted of two screw rotors 1, bearings 2*a*, 2*b*, a high pressure seal (e.g., a mechanical seal 3), a low pressure seal (e.g., a lip seal 4), a compressor main body 5 and the like. This screw compressor 10 rotatively drives two screw rotors 1 engaged with each other, compresses the air introduced from an air intake 5*a* between the two rotors, and discharges the compressed air from a discharge opening 5*b*. Incidentally, the mechanical seal can also be used as the low pressure seal, and in this case, water is supplied to both mechanical seals.

FIG. 2 is an external view of the screw compressor of FIG. 1. In this drawing, 6*a* is a pulley for driving the rotors and 5*c* is a water supply port to the mechanical seal. In the compressor of such screw compressor, since seal faces or frictional faces (the material of which is carbon or ceramics) of the rotors 1 and the mechanical seal 3 have a structure of directly sliding, water is jetted and supplied from the air intake and the water supply port 5*c* so as to lubricate the sliding faces. Incidentally, this water serves not only to lubricate and cool the sliding faces, but also to improve compression efficiency by cooling the compressed air.

FIG. 3 is a block diagram of the air compressor equipment using such a water jet type compressor. In this drawing, 7 is a fan motor (a motor with fan), 8 is a water tank, and 9 is a water cooler. The fan motor 7 drives the pulley 6*b* with a fan 7*a* for blowing the air to the water cooler 9, and rotatively drives the pulley 6*a* for driving the rotors by a belt. By the rotative driving of the pulley 6*a*, the inner rotors rotate, and the air is introduced from an air introducing line 12*a* through the air intake 5*a*. A compressed air compressed between the rotors is supplied to the water tank 8 from the discharge opening 5*b* through a compressed air line 12*b*.

In the water tank, water is supplied up to an intermediate position, and the inner water is forcibly fed to the water cooler 9 through a water line 13*a* by pressure (about 0.7 Mpa: about 7 $Kg/cm^2g$) of pressurized air supplied to the upper part, and here it is cooled and, further, it is supplied to the air intake and the water supply port 5*c* of the compressor 10 through a water line 13*b* and jetted inside thereof. The water which has lubricated and cooled the inside of the compressor 10 is circulated in the water tank 8 with the pressurized air, separated by a mist separator 8*a*, and mixed with the inner water inside the water tank 8. On the other hand, the pressurized air from which water content is eliminated is ejected from a check valve 8*b*.

As described above, in the conventional water jet type air compressor system, water is supplied to the rotors or the mechanical seal of the water jet type compressor 10 during operation, thereby providing for lubrication and cooling. However, when the compressor stops and pressure inside the water tank 8 continues to be in a normal pressure state for a long time, since the compressor is usually located at a high position, the water level goes down and the water line 13*a* and the inside(the rotors and the mechanical seal) of the compressor 10 are kept in a dry state.

For this reason, when the compressor was started in this dry state (hereinafter referred to as a dry operation), there was a problem in that the compressor was operated in a dry state during the time till a circulating water arrived at the rotors and the mechanical seal. This dry operation time is the time until pressure inside the water tank is increased by driving the compressor and the circulating water arrives at the rotors or the mechanical seal by pressure of the compressed air. This dry operation time is, for example, about 5 to 10 seconds. During this dry operation, there has been a problem in that lubricating and cooling effect are not available owing to the dry state, and compared to a state wherein water is supplied, wear and temperature rise of the rotors or the mechanical seal become severe, thereby causing inconveniences such as damages or lowering of the performance and shortening of the exchange cycle.

On the other hand, as described above, in the conventional water jet type air compressor system, water is supplied to the rotors or the mechanical seal of the water jet type compressor 10 during operation, thereby providing for lubrication and cooling. This water is circulated between the water tank and the compressor, and a part of the water mist contained in the compressed air and an evaporated water content (a vapor) are not separated by the mist separator 8*a* but supplied to a supply destination from an air outlet. Hence, there has been a problem in that the circulating water was gradually reduced, thereby requiring a periodic replenishment of the water.

Further, since no impurity is contained in the vapor lost by evaporation, when ordinary service water containing a hard component is used as starting water, there has been a problem in that impurities in the circulating water condensed and scale trouble occurred. For this reason, a demineralizer or a water quality purifying device becomes indispensable, which makes the system complex and expensive. Further, the cyclic exchange of ion exchange resin or filters becomes indispensable for the demineralizer or the water quality purifying device, thereby incurring a maintenance cost.

Further, there is a problem in that impurities in the circulating water, particularly solid material have a bad effect on frictional faces of the mechanical seal or the rotors and increases wear thereof. In order to eliminate such solid material, a filter is disposed in the circulating water path. However, if filtering accuracy is enhanced, not only is the exchange cycle of the filter shortened, but also elimination of microscopic particles by the filter as such is difficult.

Further, when the circulating water is continuously used for a long time, bacteria is bred in the circulating water, and this bacteria, accompanied by the compressed air with water mist, becomes a source of asthma and allergies. Hence, in the conventional water jet type air compressor system, there has been a problem in that the inner circulating water was required to be exchanged by periodically stopping the system with a result that a working rate of the system was reduced.

To solve these problems, for example, Japanese Patent Application Laid-open No. 1448387/1983 discloses an "Adjustment method of the water for compressor". However, this method simply and automatically supplies the water by disposing a sensor, and does not basically solve the problems as described above.

SUMMARY OF THE INVENTION

The present invention is invented to solve the problems as described above. That is to say, a first object of the present invention is to provide a water jet type air compressor system and method in which the system can be started by definitely preventing dry operation with the rotors or the mechanical seal kept in a dry state.

To achieve this object, according to the present invention, there is provided a water jet type air compressor system which is equipped with a water tank 8 for holding water therein and a compressor 10 for compressing air and which supplies the compressed air into the water tank and jets water from the water tank into the compressor by pressure at the time of the supply; said water jet type air compressor system further comprising a pressurized water jet line 20 for introducing the pressurized water from the outside of the system into the compressor, and a control system 22 for opening and closing the pressurized water jet line, said pressurized water being jetted from the outside of the system into the compressor by opening the pressurized water jet line prior to the driving of the compressor in accordance with a driving instruction of the compressor.

Further, according to the present invention, there is provided a method for starting a water jet type air compressor system which is equipped with a water tank 8 for holding water therein and a compressor 10 for compressing air and which supplies the compressed air into the water tank and jets water from the water tank into the compressor by pressure at the time of the supply; said method for starting the water jet type air compressor system comprising the steps of jetting the pressurized water from the outside of the system into the compressor by opening the pressurized water jet line in accordance with a starting instruction of the compressor, starting the compressor, and then stopping the jet of the pressurized water from the outside of the system by closing the pressurize water jet line before water is supplied from the water tank to the compressor.

According Lo the system and the method of the present invention, since the water is supplied from outside to the rotors and the mechanical seal and an electric motor is started after a certain time at the point in time when the compressor receives a starting instruction, dry operation can be avoided even if the rotors or the mechanical seal are in a dry state, thereby reducing wear of the rotors or the mechanical seal and preventing inconveniences such as damage, lowering of the performance, etc.

A second object of the present invention is to provide a water jet type air compressor system which can be operated for long hours without replenishing water and a method of water quality control. Further, another object is to provide the water jet type air compressor system which can be kept clean for long hours by reducing an impurity concentration of the circulating water without using the demineralizer or a water quality purifying system and a method of water quality control. Again, another object is to provide the water jet type air compressor system and its method of water quality control in which bacteria in the circulating water can be reduced by inhibiting propagation of the bacteria without exchanging the circulating water.

To achieve these objects, according to the present invention, there is provided a water jet type air compressor system which is equipped with a water tank 8 for holding water therein and a compressor 10 for compressing air and which supplies the compressed air into the water tank and jets water from the water tank into the compressor by pressure at the time of the supply; said water jet type air compressor system comprising a dehumidifier 120 for cooling the compressed air ejected from the water tank to a saturation temperature or less of a water content to condense and separate water, and a water recovery line 122 for supplying the water content separated by the dehumidifier to an air intake of the compressor.

Further, according to the present invention, there is provided a method of water quality control for a water jet type air compressor system which comprises a water tank 8 for holding water therein and a compressor 10 for compressing air and which supplies the compressed air into the water tank and jets water from the water tank into the compressor by pressure at the time of the supply, said method of water quality control for the water jet type air compressor system comprising the steps of cooling the compressed air ejected from the water tank to a saturation temperature or less of a given water content, condensing and separating the water content, supplying the separated water content into the compressor, and then discharging an excess circulating water from the water tank.

According to the system and the method of the present invention as described above, the water recovered from the dehumidifier 120 cooling the compressed air below the saturation temperature of water content is condensed water of water vapor scarcely containing any impurities, i.e., clean water close to demineralized water. Further, when the temperature is particularly high, a large quantity of water content is contained also in the outside air which the compressor introduces, and this water content is also recovered by the dehumidifier (120). The quantity of the condensed water is, in the ordinary case, larger than the quantity lost by evaporation. Accordingly, by supplying a large quantity of this pure condensed water to the inside of the compressor, long hours of continuous operation can be performed without replenishing water. Further, since the circulating water quantity inside the compressor gradually increases owing to a large quantity of the condensed water, by appropriately discharging an increased portion (an excess of circulating water) from the water tank, the water quality of the circulating water can be brought close to the clean water quality of the condensed water within a short period. Accordingly, even if an ordinary service water containing some impurities is used for an initial filling water without using a demineralizer or water quality purifying system, the water quality of the circulating water can be made a clean water quality close to the demineralized water within a short period, thereby making it possible to reduce an impurity concentration of the circulating water and keep the water in a pure state. Further, a water filter exchange cycle of the circulating water path can be extended and the amount of microscopic particles which can not be eliminated by a filter can also be reduced. Furthermore, as a result of a laboratory test, it was found that water can be brought close to an aseptic state within a short time.

Other objects and advantageous characteristics of the present invention will be evident from the following description with reference to the accompanying drawings.

DESCRIPTION OF THE PREFERRED EMBODIMENTS

The preferred embodiments of the present invention will be described hereinafter with reference to the drawings.

(First Embodiment)

Figure 1:
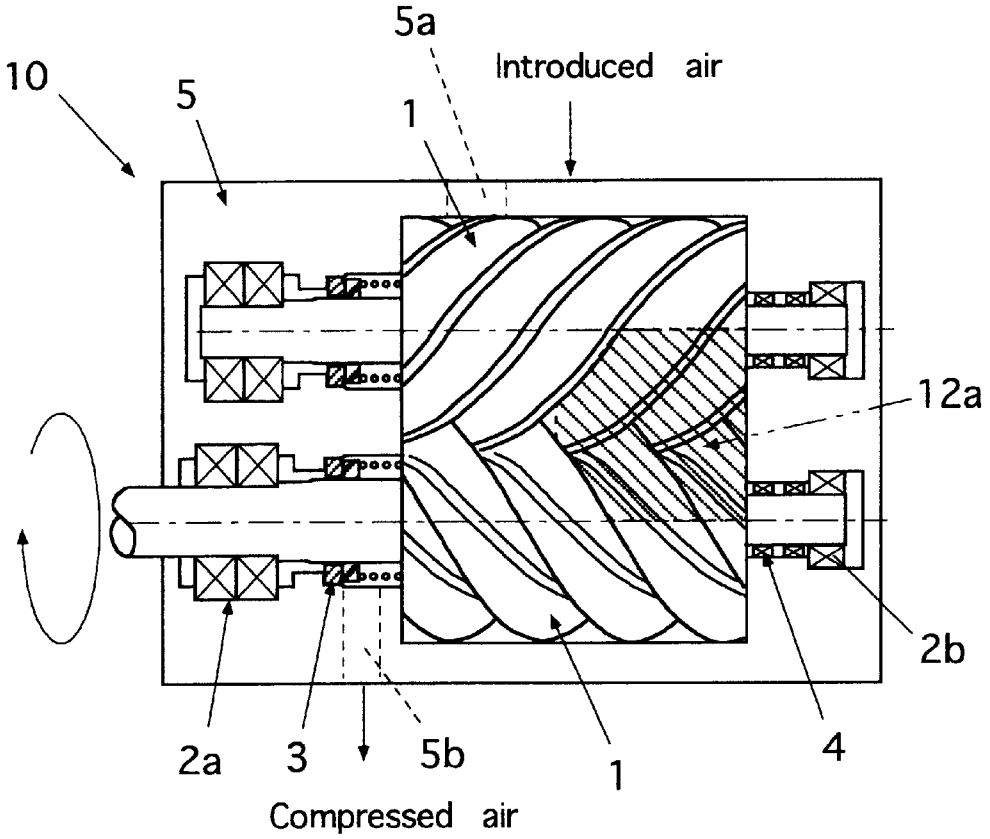
Fig.1 (prior art)
FIG. 1 is a schematic view of a screw compressor.
Figure 2:
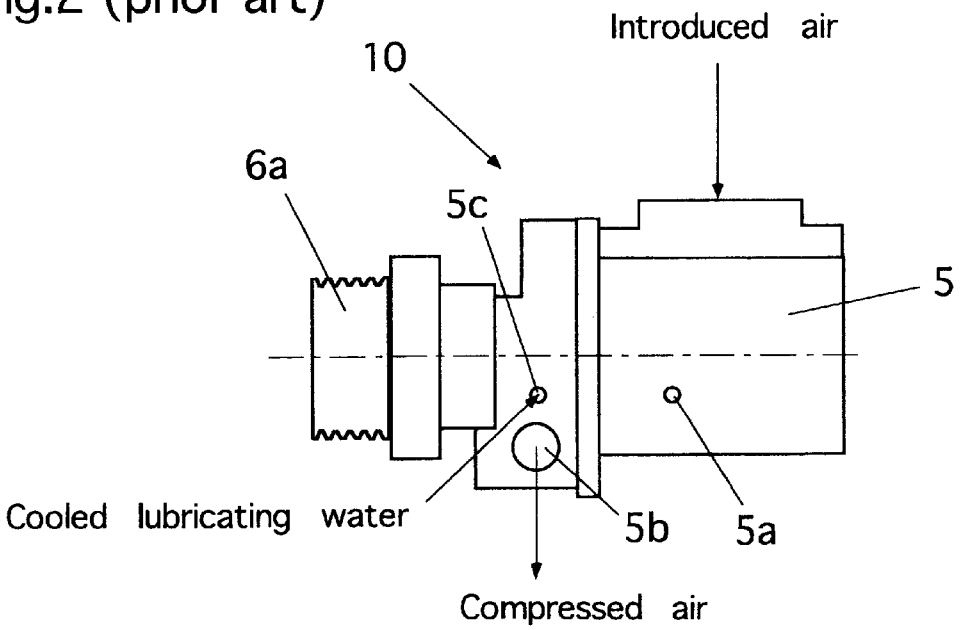
Fig.2 (prior art)
FIG. 2 is an external view of the screw compressor of FIG. 1.
Figure 3:
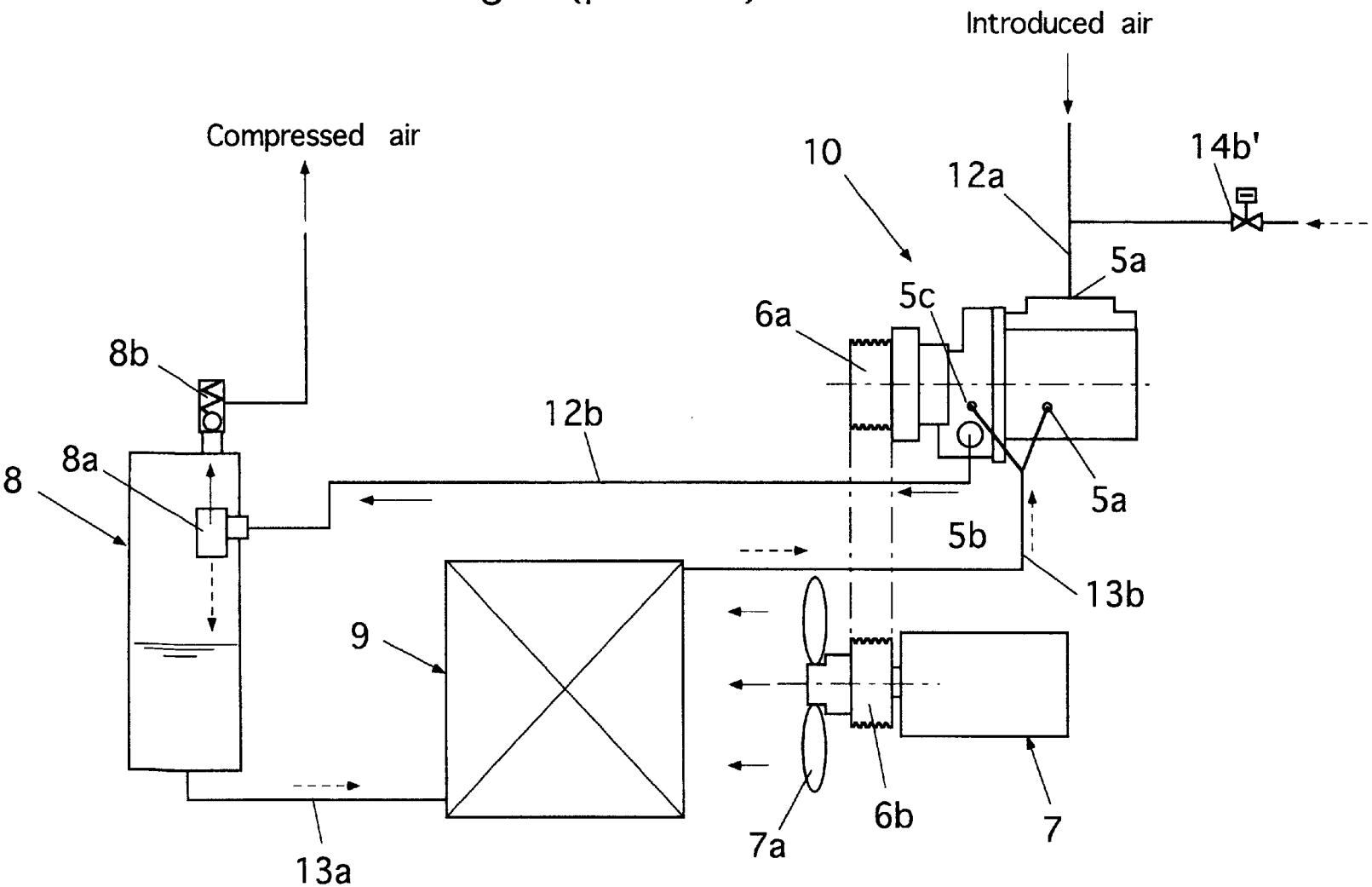
Fig. 3 (prior art)
FIG. 3 is a schematic diagram of the conventional water jet type air compressor system.
Figure 4:
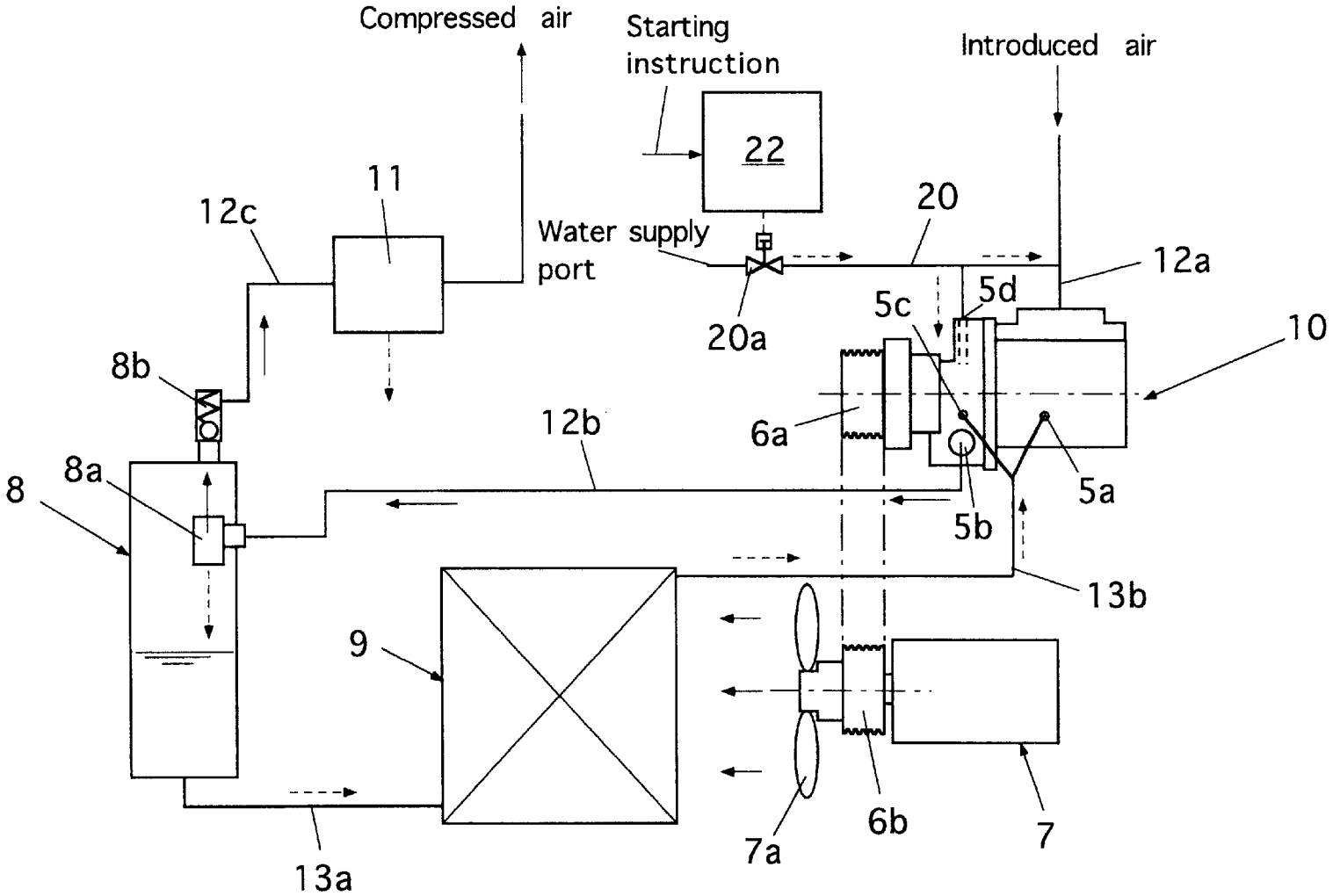
FIG. 4 is a schematic diagram of the first embodiment of the water jet type air compressor system according to the present invention.

FIG. 4 is a schematic diagram of the first embodiment of a water jet type air compressor system according to the present invention. In this drawing, 7 is a fan motor, 8 is a water tank, 9 is a water cooler, and 11 is a dehumidifier.

The fan motor 7 drives a pulley 6*b* with a fan 7*a* for blowing the air to the water cooler 9,and rotatively drives a pulley 6*a* for driving rotors by a belt. By the rotative driving of the pulley 6*a*, the inner rotors rotate. The air is introduced from an air introducing line 12*a* through an air intake 5*a*. The compressed air compressed between the rotors is supplied to the water tank 8 from a discharging port 5*b* through a compressed air line 12*b*.

The water tank 8 is equipped with a water level indicator, a water supply valve, a water discharging valve, etc. and is always supplied with water up to a certain intermediate position. This quantity is, for example, about 10 to 20 liters. The water supply valve (i.e., a feed valve used for operating time) is also Located in the vicinity of a compressor 10. Further, the compressed air compressed between the rotors is supplied to the upper part of this water tank 8 and always kept inside within a predetermined range of pressure (e.g., about 0.7 Mpa or more; about 7 $Kg/cm^2g$ or more). By this pressure, the inner water is forcedly fed to the water cooler 9 through a water line 13*a* during the ordinary operating time, and here it is cooled by the blowing air from the fan 7*a* and always kept at the outside air temperature +10° C. or so.

Further, the cooled water inside the water cooler 9 is supplied to the air intake and the water supply port 5*c* of the compressor 10 through a water line 13*b* by an air pressure inside the water tank 8. At the confluence of this water line 13*b* and the air intake, and at the water supply port 5*c*, a nozzle not shown is disposed so as to jet an appropriate quantity of the water to the inside of the compressor 10 with the pressure at the water tank 8 side kept as it is. This water jet quantity is established so as to moisten and lubricate the sliding faces of the inner rotors and the mechanical seal, and to cool the inner rotors and the mechanical seal to keep the temperature thereof within an appropriate range, and also to lower the temperature of the compressed air and improve compression efficiency of the compressor.

Next, the water which lubricates and cools the inside of the compressor 10 is circulated inside the water tank 8 with pressurized air from the discharging port 5*b* through the compressed air line 12*b*, and mixed with the inner water of the water tank 8 after it is separated by a mist separator 8*a*. Further, the pressurized air from which the water content is eliminated is ejected from a check valve 8*b*, supplied to a dehumidifier 11 through a compressed air line 12*c*, and supplied from an air outlet after it is dehumidified. The temperature of the compressed air ejected from the water tank 8 is, for example, the outside temperature +20° C. or so and contains water content. For this reason, the dehumidifier 11 lowers the pressurized air below a saturation temperature of water content once, condenses and eliminates the inner water content thereof, and then raises it above the outside temperature after it is heated again. Accordingly, a dry compressed air with water content scarcely contained therein can be supplied.

The water jet type air compressor system according to the present invention is further provided with a pressurized water jet line 20 for introducing the pressurized water from the outside system and a control system 22 for opening and closing the pressurized water jet line 20. The pressurized water jet line 20 is disposed with, for example, an electromagnetic switching valve 20*a*. Further, the pressurized water line 20 is connected to, for example, a line of the pressurized water such as a service water, etc. (a water supply inlet) and, by opening the line, the pressurized water from the outside system is supplied to the air intake 5*a* and the water supply port 5*c* of the compressor 10. A water supply port 5*d*, in this embodiment, is disposed separately from the water supply port 5*c* of the compressor 10, and supplies water to the mechanical seal in the same manner as the water supply port 5*c*. Incidentally, water may be directly supplied to the water supply port 5*c* instead of the water supply port 5*d*. Further, if necessary, a nozzle may be disposed at the confluence of the pressurized water jet line 20 and the air intake 5*a*, and at the water supply port 5*d*.

According to the structure and the method of the present invention described above, a control system 22 opens an electromagnetic switching valve 20*a* upon receipt of a starting instruction from the compressor, jets the pressurized water to the inside of the compressor from the outside system, and then starts the compressor 10. The jet of the pressurized water from the outside system is performed, for example, about three seconds before the compressor 10 is started, and stopped after the compressor 10 is started. This stopping of the jet of the pressurized water is preferably performed before the water is supplied to the compressor from the water tank 8. For example, since the water is supplied from the water tank 8 usually within about five seconds after the compressor is started, it is preferable for the pressurized water to stop before that, that is to say, right after the compressor is started. Incidentally, even if the pressurized water jet line 20 is continuously opened, the water supply from the line is automatically stopped when the inner pressure of the compressor 10 rises.

According to the system and the method of the present invention as described above, since the water is supplied to the rotors and the mechanical seal from the outside at a time when the compressor 10 receives the starting instruction and starts the electric motor after a certain time, the rotors and the mechanical seal can avoid being operated in a dry state even if they are in a dry state. Thus, wear of the rotors and the mechanical seal can be reduced and inconveniences such as damage and lowering of performance can be prevented.

As described above, the water jet type air compressor system and its starting method according to the present invention have various excellent effects in which the compressor can be started even after it is stopped for a long time by definitely preventing dry operation with the rotors and the mechanical seal kept in a dry state.

Although, in the above described embodiment, the description has been made mainly about a case of the screw compressor, other compressors may be used as far as they are of a water jet type. Again, though the description has been made about a case of the air compression, other gases may be used as well.

(Second Embodiment)

Figure 5:
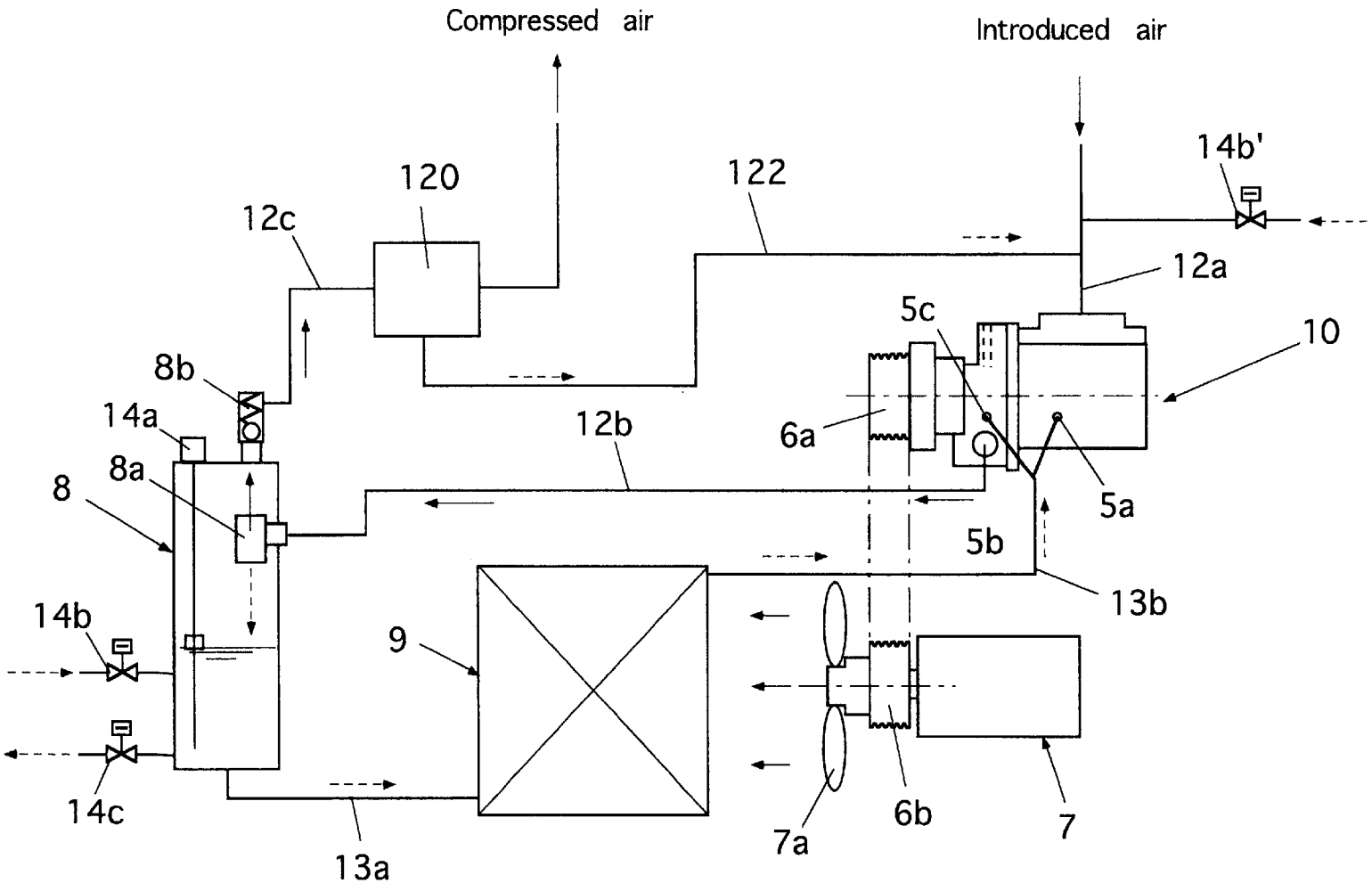
FIG. 5 is a schematic diagram of the second embodiment of the water jet type air compressor system according to the present invention.

FIG. 5 is a schematic diagram of a water jet type air compressor system of the second embodiment according to the present invention. In this drawing, 7 is a fan motor, 8 is a water tank, and 9 is a water cooler. The fan motor 7 drives a pulley 6*b* with the water cooler 9 for blowing the air to the water cooler 9, and rotatively drives a pulley 6*a* for driving rotors by a belt. By the rotative driving of the pulley 6*a*, the inner rotors rotate. The air is introduced from an air introducing line 12*a* through an air intake 5*a*. The compressed air compressed between the rotors is supplied to the water tank 8 from a discharging port 5*b* through a compressed air line 12*b*.

The water tank 8 is equipped with a water level indicator 14*a*, a water supply valve 14*b*, a water discharging valve 14*c*, etc. and always supplied with water up to a certain intermediate position. This quantity is, for example, about 10 to 20 liters. In this case, the water supply valve 14*b* is used for supply purpose when an operation is stopped, and a supply valve used when the operation is started is separately available as a water supply valve 14*b*'. Further, the compressed air compressed between the rotors is supplied to the upper part of the water tank 8 and always kept inside within a predetermined range of pressure (e.g., about 0.7 Mpa or more; about 7 $Kg/cm^2g$ or more). By this pressure, the inner water is forcedly fed to the water cooler 9 through a water line 13*a* during the ordinary operating time, and here it is cooled by the blowing air from the fan 7*a* and kept at the outside temperature + about 10° C.

Further, the cooled water inside the water cooler 9 is supplied to the air intake and a water discharge port 5*c* of a compressor 10 through a water line 13*b* by air pressure inside the water tank 8. At the confluence of this water line 13*b* and the air intake, and at the water supply port 5*c*, a nozzle not shown is disposed so as to jet an appropriate quantity of the water to the inside of the compressor 10 with the pressure at the water tank 8 side kept as it is. This water jet quantity is established so as to moisten and lubricate the sliding faces of the inner rotors and a mechanical seal to keep the temperature thereof within an appropriate range and also to lower the temperature of the compressed air and improve compression efficiency of the compressor.

In this connection, by disposing a filter (not shown) between the water cooler 9 and the compressor 10, a water filter exchange cycle of the circulating water path can be extended and even microscopic particles which can not be eliminated by the filter can be reduced.

Next, the water which lubricates and cools the inside of the compressor 10 is circulated inside the water tank 8 with the compressed air from the discharging port 5*b* through the compressed air line 12*b*, and mixed with the inner water of the water tank 8 after it is separated by a mist separator 8*a*. Further, the compressed air from which water content is eliminated is ejected from a check valve 8*b*.

The water jet type air compressor system according to the present invention is further provided with a dehumidifier 120 which cools the compressed air ejected from the water tank 8 and condenses and separates the water content thereof, and a water content recovery line 122 which supplies the water content separated by the dehumidifier 120 to the air intake of the compressor. The compressed air ejected from the check valve 8*b* is supplied to the dehumidifier 120 through a compressed air line 12*c*, and supplied from an air outlet after it is dehumidified. The temperature of the compressed air ejected from the water tank 8 is, for example, the outside temperature + about 20° C. and contains water content. For this reason, the dehumidifier 120 lowers the compressed air below a saturation temperature of water content once, condenses and separates the inner water content thereof, and then raises it above the outside temperature after it is heated again. Accordingly, a dry compressed air with water content scarcely contained therein can be supplied.

Further, the water content recovery line 122 supplies the recovered water content to an upstream side or a downstream side of an air intake valve of the compressor 10. By this structure, the water content can be supplied to the inside of the compressor 10 without particularly being pressurized.

With the structure as described above, according to the present invention, the compressed air ejected from the water tank 8 is cooled by the dehumidifier below a saturation temperature of water content, and the water content thereof is condensed and separated. The water content separated by the water content recovery line 122 is supplied to the inside of the compressor, and when the circulating water is more than enough, an excess circulating water is discharged from the water tank 8 through a water discharging valve 14*c*.

According to the system and the method of the present invention as described above, the water recovered from the dehumidifier 120 which cools the compressed air below a saturation temperature of water content is condensed water of water vapor which scarcely contains any impurities and is clean water close to demineralized water. Further, a large quantity of the water content is contained even in the outside air introduced by the compressor 10 when the temperature is high, and this water content too is recovered by the dehumidifier 120. For this reason, the water quantity of the condensed water is, in the ordinary case, larger than the quantity lost by evaporation. Accordingly, by supplying this large quantity of the clean condensed water to the inside of the compressor 10 through the water recovery line 122, long hours of continuous operation can be performed without replenishing water.

Further, since the circulating water inside the compressor 10 gradually increases as the water quantity of the condensed water is much, by appropriately discharging an increased portion (an excess circulating water) from the water tank, the quality of the circulating water can be brought close to the quality of the clean condensed water within a short period. Accordingly, even if ordinary service water which contains some impurities is used for an initial filling water without using a demineralizer or a water quality purifying system, the quality of the circulating water can be made clean with a quality close to the demineralized water within a short period, thereby reducing impurity concentration of the circulating water and keeping the water clean for long hours. Further, as a result of a laboratory test, it was found that the water can be brought close to an aseptic state within a short time.

Figure 6:
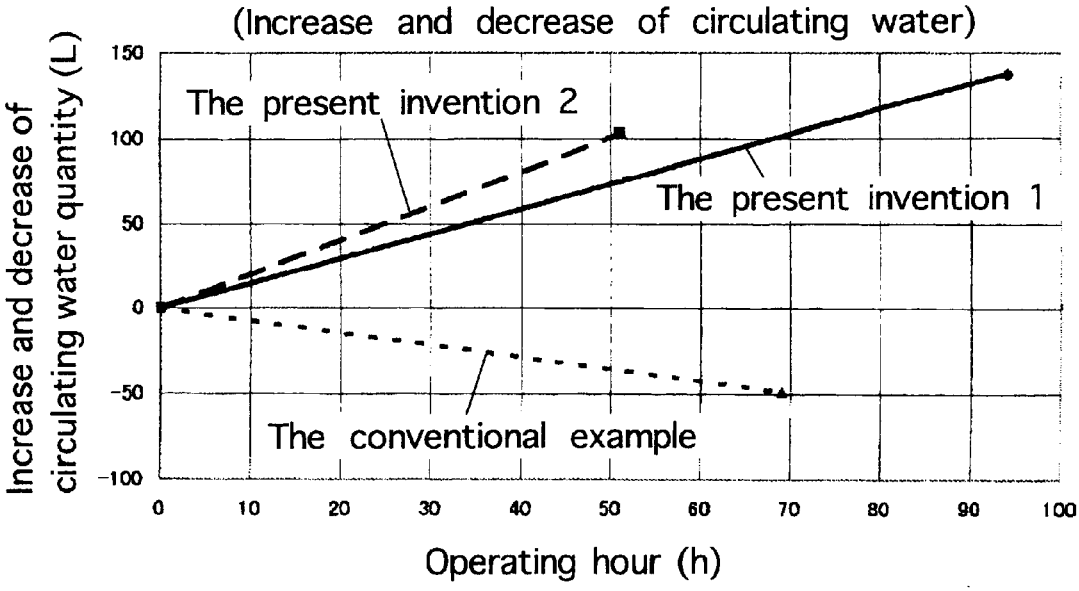
FIG. 6 is a drawing to show a test result of the air compressor system of FIG. 5.

FIG. 6 is a drawing to show a test result of the air compressor system of FIG. 5. In this drawing, abscissa shows an operating hour, and the ordinate shows an increase and decrease in quantity. Furthermore, in the actual operation, total quantity of a supply and discharge was measured since supply and discharge is performed to maintain a certain water level. From this drawing, it is evident that, while the same quantity of make-up water as an inner circulating quantity is required for every thirty hours in the conventional example, in the system of the present invention, the more the operating time elapses, the more the circulating water is increased for both embodiments of the present inventions 1, 2, and diluted by the same quantity of condensed water as of circulating water within about ten hours. Accordingly, as described above, by supplying a large quantity of the clean condensed water to the inside of the compressor 10 through the water recovery line 122, long hours of continuous operation can be performed without replenishing water.

Figure 7A:
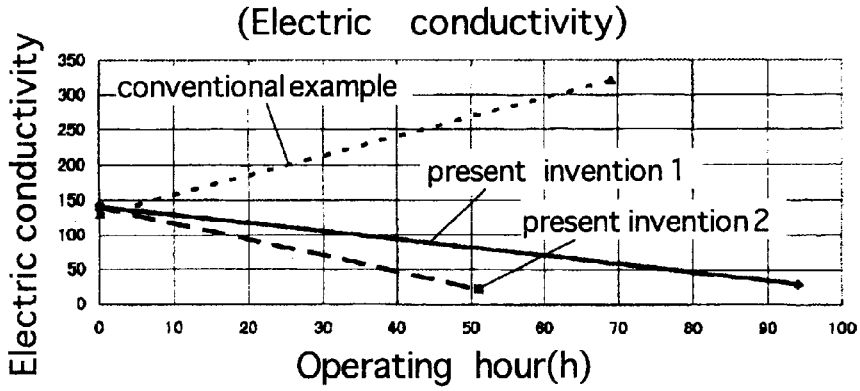
FIG. 7A is a test result of electric conductivity.
Figure 7B:
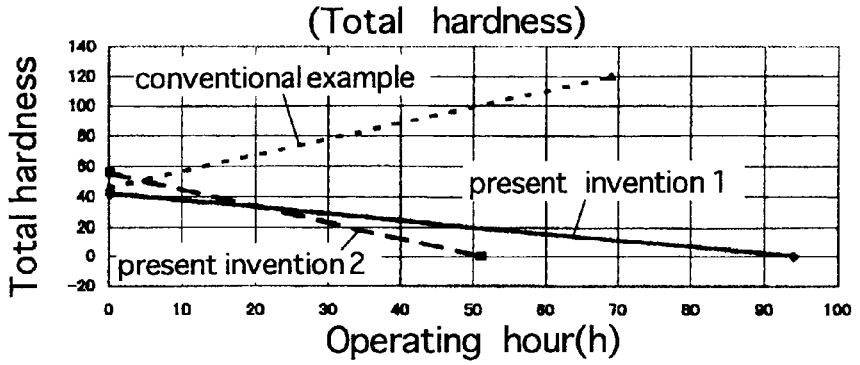
FIG. 7B is a test result of total hardness.
Figure 7C:
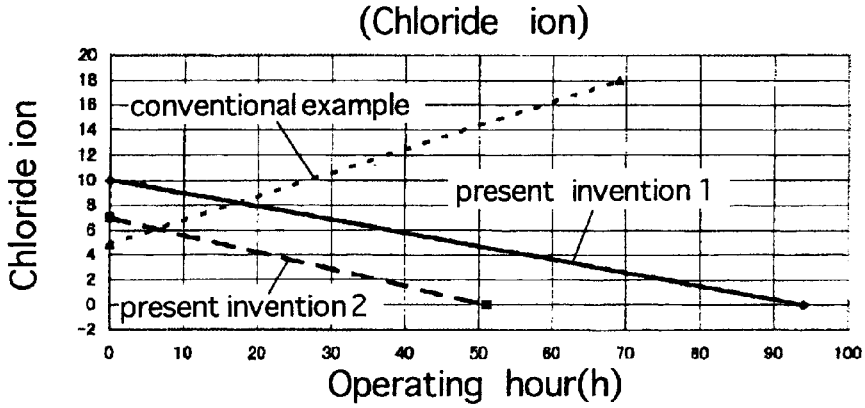
FIG. 7C is a test result of chloride ion.
Figure 7D:
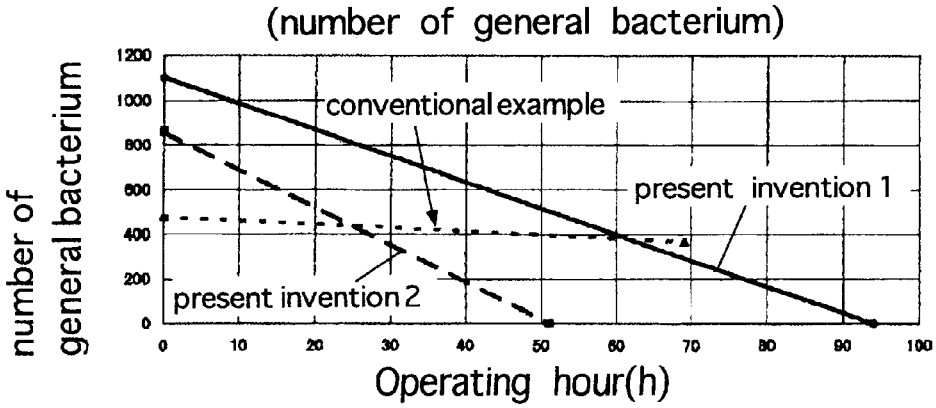
FIG. 7D is a test result of a number of general bacteria.

FIG. 7A is a test result of electric conductivity, FIG. 7B is a test result of total hardness, FIG. 7C is a test result of chloride ion, and FIG. 7D is a test result of the number of general bacterium. Further, in each drawing, the abscissa shows the operating time.

From FIG. 7A, FIG. 7B and FIG. 7C, it is apparent that electric conductivity, total hardness and chloride ion are reduced for both embodiments of the present inventions 1, 2 the more the operating time elapses.

Electric conductivity of FIG. 7A is an index of the quantity of all impurities, and demineralized water is close to zero. Therefore, demineralization of the circulating water by the reduction evident from FIG. 7A.

Further, total hardness of FIG. 7B is the quantity of calcium and magnesium, and chloride ion of FIG. 7C is the quantity of chloride ion in the water. Both of these are zero in demineralized water. Accordingly, demineralization by a drain, scale proof effect and preservation effect are evident from FIG. 7B and FIG. 7C.

FIG. 7D is the number of general bacterium in the circulating water, and measures the number of general bacterium contained in 1 ml. There is no change in the conventional example, and this level is presumed to be a limit count in which the general bacterium can live in the circulating water path. On the other hand, in the present inventions 1 and 2, the number of general bacterium reaches zero after about 94 hours, about 51 hours, and it is evident that there is some aseptic action available there.

As described above, the water jet type air compressor system and its water quality control method according to the present invention have various excellent advantages in which (1) long hours of continuous operation can be performed without replenishing water, (2) impurities in the circulating water can be reduced to keep the water clean for long hours of without using a demineralizer or water quality purifying system, (3) propagation of bacteria can be inhibited to reduce the amount of bacteria in the circulating water without exchanging the circulating water, (4) a water filter exchange cycle of the circulating water path can be extended if a filter is provided and even microscopic particles which can not be eliminated by the filter can be reduced.

Although, in the embodiment as described above, the description has been made mainly about a screw compressor, other compressors may be used as far as they are of a water jet type.

While the present invention has been described with reference to a few preferred embodiments, it will be understood that the scope of the right included in the present invention is not limited to those embodiments. On the contrary, the scope of the right of the present invention embraces all improvements, modifications and equivalents included in the appended claims.

What is claimed is:

1. A method of operating a water jet air compressor system comprising a circulating water tank holding water therein, and a compressor, comprising the steps of:

supplying compressed air from the compressor to the circulating water tank;

jetting water from the circulating water tank into the compressor, when the water tank is supplied with compressed air;

jetting pressurized water from an outside pressurized water line into the compressor by opening the outside pressurized water line prior to driving the compressor.

2. A method according to claim 1, further comprising the steps of:

opening the outside pressurized water line in accordance with a starting instruction to the compressor;

starting the compressor; and stopping the jet of pressurized water from the outside pressurized water line by closing the outside pressurized water line before water is supplied from the water tank to the compressor.

3. A method according to claim 1, further comprising the steps of:

cooling compressed air ejected from the water tank with a dehumidifier to condense and separate water from the air;

recovering the separated water in a water recovery line; and supplying the water in the water recovery line to an air intake of the compressor.

4. A method according to claim 3, further comprising the steps of:

discharging an excess of water from the circulating water tank.

5. A method according to claim 1, wherein water circulating in the circulating water tank is gradually removed of impurities.

* * * * *